US005417725A

United States Patent [19]

Graves

[11] Patent Number: 5,417,725

[45] Date of Patent: May 23, 1995

[54] PENETRATION AND FIXTURE FREEING AGENT

[76] Inventor: Gordon C. Graves, 2764 Nipoma St., San Diego, Calif. 92106

[21] Appl. No.: 189,898

[22] Filed: Feb. 1, 1994

[51] Int. Cl.[6] ..... C10L 1/18

[52] U.S. Cl. ..... 44/388; 44/400; 44/451

[58] Field of Search ..... 44/388, 400

[56] References Cited

U.S. PATENT DOCUMENTS

| | | | |
|---|---|---|---|
| 2,809,160 | 10/1957 | Stewart et al. | 252/33.4 |
| 3,433,607 | 3/1969 | Fareri et al. | 44/400 |
| 3,656,886 | 4/1972 | Blytas | 252/396 |
| 3,879,176 | 4/1975 | Tsunemi | 44/398 |
| 3,923,539 | 12/1975 | Jorns | 134/2 |
| 4,101,328 | 7/1978 | Fieser et al. | 428/624 |
| 4,156,655 | 5/1979 | Clarke et al. | 252/18 |
| 4,289,638 | 9/1981 | Svenson | 252/85 |
| 4,304,707 | 12/1981 | Kuehn | 260/37 R |
| 4,418,231 | 11/1983 | Pamer | 570/115 |
| 4,578,407 | 3/1986 | Amabile et al. | 524/55 |
| 4,957,704 | 9/1990 | Dohner | 422/14 |
| 5,037,485 | 8/1991 | Chromecek et al. | 134/7 |
| 5,176,840 | 1/1993 | Campbell et al. | 252/49.6 |
| 5,186,863 | 2/1993 | Mancini | 252/570 |
| 5,200,103 | 4/1993 | Song et al. | 252/51.5 R |
| 5,204,012 | 4/1993 | Schaffhausen | 252/52 A |
| 5,211,865 | 5/1993 | Patil et al. | 252/56 D |
| 5,225,093 | 7/1993 | Campbell et al. | 252/515 A |

*Primary Examiner*—Ellen M. McAvoy
*Attorney, Agent, or Firm*—Fliesler, Dubb, Meyer & Lovejoy

[57] ABSTRACT

The present invention relates to a composition that is useful as a penetration and fixture freeing agent. Specifically, the composition aids in the freeing of metal fixtures, such as hardware. In a preferred embodiment, the composition is a combination of a lower alkyl aromatic carboxylic acid ester, a lower alkyl alcohol, and a light petroleum distillate vehicle or carrier. In a highly preferred embodiment, the composition is methyl salicylate, isopropanol, and kerosene.

10 Claims, No Drawings

PENETRATION AND FIXTURE FREEING AGENT

BACKGROUND OF THE INVENTION

1. Field of the Invention

The present invention relates to compositions that are useful as penetration and fixture freeing agents. Specifically, the compositions aid in the freeing of metal fixtures, such as hardware.

2. Background of the Art

Metal fixtures and hardware, upon standing in corrosive environments, often become frozen. For example, the threads of nuts and bolts will often lock or corrode together, effectively preventing disassembly.

Similarly, metal fabrication is often accomplished using mixed or dissimilar metals. For example, the housing of an object is often made from a first metal, while the fasteners are produced from a second metal. Because of the dissimilarities in the metals, the fasteners are more likely to corrode due to galvanic action and become frozen together.

In response to these problems, the prior art developed compositions to assist in the freeing of such frozen hardware and fixtures. There are several penetration and fixture freeing compositions known in the prior art. Such compositions can be applied to corroded or otherwise frozen hardware or fixtures. The compositions upon standing in contact with the hardware or fixture and thereafter will aid in their freeing.

One example of such a composition is a product marketed as WD-40®. This product is a lubricating oil composition. Another similar composition is a product marketed as 3-in-1 oil.

Each of these products have a lubricating oil component. The lubricating oil appears to limit the penetration of the compositions into tight or highly corroded portions of the fixtures or hardware. Further, these products often require prolonged standing periods before the fixture or hardware is freed.

Carboxylic acids are known rust inhibitors. Salicylic acid and its esters are known as an effective rust inhibitors.

Nevertheless, there is a continuing need in the art for an improved penetration and fixture freeing agent.

SUMMARY OF THE INVENTION

In accordance with a preferred embodiment of the present invention, there is provided a penetration and fixture freeing agent, comprising 5–25% by volume of an aromatic carboxylic acid ester having the following general structure:

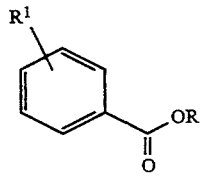

wherein R is a linear, branched, or substituted alkane with from 1 to 5 carbon atoms and $R^1$ is selected from the group consisting of hydrogen, hydroxyl, carboxyl, carboxy esters, and alkyl radical groups; and 5–30% by volume of a linear or branched alkyl alcohol from 1 to 6 carbon atoms; in a vehicle or carrier comprising a light petroleum distillate.

Preferably, the aromatic carboxylic acid ester is methyl salicylate. In one preferred embodiment, the methyl salicylate is included at about 10–15%, preferably about 12–13% by volume. In a preferred embodiment, the alcohol is isopropanol, more preferably the alcohol is anhydrous isopropanol. In a preferred embodiment, the isopropanol is included at about 15–20%, preferably about 16.5–17.5% by volume. In a preferred embodiment, the vehicle or carrier is kerosene.

In accordance with another embodiment of the invention, there is provided a penetration and fixture freeing agent, comprising about 12–13% by volume methyl salicylate, about 16.5–17.5% by volume isopropyl alcohol, in a light petroleum distillate. Preferably, the petroleum distillate is kerosene and the isopropyl alcohol is anhydrous.

DETAILED DESCRIPTION OF THE PREFERRED EMBODIMENTS

In accordance with a preferred embodiment of the present invention, there are provided penetration and fixture freeing agents that are superior to prior art compositions. The compositions comprise a combination of a lower alkyl aromatic carboxylic acid ester, a lower alkyl alcohol, and a light petroleum distillate vehicle or carrier.

In a preferred embodiment, the carboxylic acid ester has the following general structure:

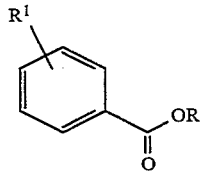

wherein R is a linear, branched, or substituted alkane with from 1 to 5 carbon atoms and $R^1$ is either hydrogen or represents an ortho, meta, or para ring substitution, preferably selected from the group consisting of hydroxyl, carboxyl, carboxy esters, or alkyl groups. In a preferred embodiment, $R^1$ is either hydroxyl or an additional carboxylic acid group. In a highly preferred embodiment, R is methyl and $R^1$ is an ortho hydroxyl and the compound is methyl salicylate.

The alcohol is preferably a linear or branched alkyl alcohol from 1 to 6 carbon atoms. In a particularly preferred embodiment, the alcohol is isopropanol, more preferably, anhydrous isopropanol.

The vehicle or carrier is preferably a light petroleum distillate. It is preferred that the vehicle or carrier not be highly flammable. Accordingly, in a preferred embodiment, the vehicle or carrier is kerosene. However, as will be appreciated, the use of other petroleum distillates is contemplated in accordance with the invention.

Each of the alcohol and the aromatic carboxylic acid ester are preferably soluble in the vehicle or carrier. Thus, methanol is not appropriate when the vehicle or carrier is kerosene.

In a preferred embodiment, the carboxylic acid ester is included at a ratio of about 5% to 10% to about 15% to 20% by volume. The alkyl alcohol is included at a ratio of about 5 to 30% by volume. The vehicle or carrier is included to make up the balance. In a highly preferred embodiment, where the aromatic carboxylic acid ester is methyl salicylate, the alcohol is isopropanol, and the petroleum distillate is kerosene, the ratio of the materials is shown in the following Table I:

TABLE I

| Ingredient | Percent by Volume |
|---|---|
| Methyl Salicylate | 12–13 |
| Isopropanol | 16.5–17.5 |
| Kerosene | Balance |

Compositions prepared in accordance with the present invention are very effective penetration and fixture freeing agents. They may be applied to any virtually any frozen fixture. For example, they are extremely effective in freeing frozen metal fixtures and hardware. Even dissimilar metals are easily freed upon their application. Exemplary dissimilar metal systems in which the compositions of the present invention are particularly effective include the following: brass to copper; copper to cast-iron; cast-iron to brass; and aluminum to steel. Furthermore, the compositions of the present invention will free rubber and plastic materials, such as radiator or cooling system hoses, without apparent harm to the material.

Without wishing to be bound to any particular theory or mode of operation, the invention appears to operate through a combined mechanism of the alkyl alcohol enhancing penetration of the aromatic carboxylic acid ester and the aromatic carboxylic acid ester dissolving or weakening, for lack of a better word, the bond freezing the fixture or hardware. For example, in corroded hardware applications, such as corroded and frozen nuts and bolts, the composition, after application, visibly penetrates the threads of the hardware and the corrosion in the threads loses binding strength, even appearing to decay and/or dissolve.

Further details of the invention will be apparent from the following examples.

EXAMPLE 1

Preparation of a Preferred Composition

A preferred penetration and fixture freeing agent of the present invention was prepared by mixing 12 ml of methyl salicylate with 16.5 ml of anhydrous isopropanol in sufficient kerosene to make up 100 ml.

EXAMPLE 2

Freeing Hardware and Fixtures

A highly corroded steel nut and bolt are frozen together. Approximately 1 to 3 ml. of the composition of Example 1 is applied to the threads and allowed to stand for between 5 to 15 minutes. Thereafter, the nut and bolt come apart easily.

EXAMPLE 3

Comparative Example With Lubricating Oil

An automotive mechanic performing a rear brake job on a car found that the adjusting stars on the right and left side brakes of the car were frozen shut. The mechanic sprayed both sets with penetrating oil but could not free them. The mechanic placed the right star in a vise and heated it with a torch. At the same time the mechanic applied the composition of Example 1 to the left star.

The right star, still in the vise, would not budge until after about ten minutes of high torque and only after damaging the teeth of the star. Thereafter, the mechanic picked up the left star that had been treated with the composition of Example 1 and put it in the vise and it came loose in the mechanic's hand.

EXAMPLE 4

Preparation of Test Hardware

In order to test the specific ability of the compositions of the present invention to free hardware in relation to the ability of prior art compositions, test hardware is prepared as described below.

A series of steel nuts and bolts are tightly secured and are exposed to a brine solution and kept in relatively high humidity at a relatively elevated temperature with plenty of air circulation. They are allowed to sit and corrode for 4 weeks. In the beginning of the fourth week, they are allowed to air dry and a small number are tested to free a sample set thereof. In the sample set, they will not free or fail prior to becoming freed.

EXAMPLE 5

Test Hardware Evaluation with the Compositions of the Present Invention and Other Commercially Available Penetration Agents Sixteen sets of two nut/bolt pairs prepared in Example 4 are separated into 4 groups and treated with 1–3 ml of the following compositions:

methyl salicylate alone;

WD-40;

Three-in-one oil; and

The composition of the present invention in Example 1.

Each of the nut/bolts are allowed to stand for 5 to 15 minutes and are thereafter held in a vice and turned with a wrench to determine if the bolt can be freed from the nut.

With the composition of the present invention, we are able to free all of the samples, whereas with the other compositions, some will free and others will not.

The foregoing description details specific methods and specific compositions that can be employed to practice the present invention, and represents the best mode contemplated. However, it will be apparent to those of ordinary skill in the art that the disclosed embodiments may be modified without departing from the essence of the invention. Thus, however detailed the foregoing may appear in text, it should not be construed as limiting the overall scope hereof; rather, the ambit of the present invention is to be governed only by the lawful construction of the appended claims and any equivalents thereof.

What I claim is:

1. A penetration and fixture freeing agent, comprising:

about 5–25% by volume of an aromatic carboxylic acid ester having the following general structure:

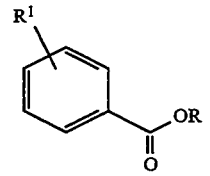

wherein R is a linear, branched, or substituted alkane with from 1 to 5 carbon atoms and $R^1$ is selected from the group consisting of hydrogen, hydroxyl, carboxyl, carboxy esters, and alkyl radical groups; and about 5–30% by volume of a linear or branched alkyl alcohol from 1 to 6 carbon atoms;

in a vehicle or carrier comprising a light petroleum distillate.

2. The agent of claim 1, wherein the aromatic carboxylic acid ester is methyl salicylate.

3. The agent of claim 2, wherein the methyl salicylate is included at about 12–13% by volume.

4. The agent of claim 1, wherein the alcohol is isopropanol.

5. The agent of claim 3, wherein the isopropanol is anhydrous.

6. The agent of claim 4, wherein the isopropanol is included at about 16.5–17.5% by volume.

7. The agent of claim 1, wherein the vehicle or carrier is kerosene.

8. A penetration and fixture freeing agent, comprising about 12–13% by volume methyl salicylate, about 16.5–17.5% by volume isopropyl alcohol, in a light petroleum distillate.

9. The agent of claim 8, wherein the petroleum distillate is kerosene.

10. The agent of claim 8, wherein the isopropyl alcohol is anhydrous.

* * * * *